US007290654B2

(12) United States Patent
Hodges

(10) Patent No.: US 7,290,654 B2
(45) Date of Patent: Nov. 6, 2007

(54) COVER FOR REMOTE CONTROL DEVICE

(76) Inventor: Richard P. Hodges, 5126 Westwood Blvd., Culver City, CA (US) 90230

( * ) Notice: Subject to any disclaimer, the term of this patent is extended or adjusted under 35 U.S.C. 154(b) by 170 days.

(21) Appl. No.: 11/341,342

(22) Filed: Jan. 28, 2006

(65) Prior Publication Data

US 2006/0124482 A1 Jun. 15, 2006

Related U.S. Application Data

(63) Continuation-in-part of application No. 11/212,459, filed on Aug. 25, 2005, now abandoned, and a continuation-in-part of application No. 10/712,727, filed on Nov. 12, 2003, now abandoned.

(51) Int. Cl.
*B65D 85/38* (2006.01)

(52) U.S. Cl. ..... 206/320

(58) Field of Classification Search ..... 206/305, 206/320, 205, 316.1, 316.2, 497; 150/154
See application file for complete search history.

(56) References Cited

U.S. PATENT DOCUMENTS

| | | | | |
|---|---|---|---|---|
| RE24,166 | E | 6/1956 | Stiller | |
| 4,546,217 | A | 10/1985 | Frehn | |
| 4,733,776 | A | 3/1988 | Ward | |
| 4,762,227 | A | 8/1988 | Patterson | |
| 4,836,256 | A | 6/1989 | Meliconi | |
| 4,901,852 | A | 2/1990 | King | |
| 4,953,703 | A | 9/1990 | Virginio | |
| 5,021,638 | A | 6/1991 | Nopper et al. | |
| D320,714 | S | 10/1991 | Singley | |
| 5,092,459 | A | 3/1992 | Uljanic et al. | |
| 5,316,141 | A | 5/1994 | Jalomo | |
| D355,302 | S | 2/1995 | Eva et al. | |
| 5,388,691 | A | 2/1995 | White | |
| 5,472,281 | A | 12/1995 | Phelps | |
| D368,095 | S | 3/1996 | McCallister, III | |
| 5,499,713 | A | 3/1996 | Huffer | |
| 5,873,456 | A | 2/1999 | Hull et al. | |
| 6,050,407 | A | 4/2000 | Trujillo | |
| 6,082,535 | A | 7/2000 | Mitchell | |
| 6,273,252 | B1 | 8/2001 | Mitchell | |
| 6,305,540 | B1 | 10/2001 | Crawford et al. | |
| 6,471,056 | B1 | 10/2002 | Tzeng | |
| 6,634,494 | B1 | 10/2003 | Derr et al. | |
| 6,817,470 | B1 * | 11/2004 | Goldberg | 206/320 |
| 7,011,213 | B2 * | 3/2006 | Clark et al. | 206/438 |
| 7,147,105 | B2 * | 12/2006 | Gammons | 206/320 |

* cited by examiner

*Primary Examiner*—Luan K Bui
(74) *Attorney, Agent, or Firm*—John S. Christopher

(57) ABSTRACT

A disposable cover for use with a remote control device for providing a protective sanitation barrier to human infection includes a rear member having a flat surface. A front curved member is integrally molded in a seamless unitary, one-piece construction with the rear member at a plurality of rounded surfaces to form a single-use, disposable protective enclosure. An anti-bacterial compound impregnates the rear member, the front curved member and the rounded surfaces for destroying bacteria on the remote control device. An orifice is formed in the rear member for enabling the remote control device to be inserted into and removed from the enclosure. Finally, the front member, rear member and the rounded surfaces are comprised of a flexible, stretchable and transparent material for conforming to the shape of the remote control device for providing a disposable, protective sanitation barrier to human infection.

15 Claims, 3 Drawing Sheets

COVER FOR REMOTE CONTROL DEVICE

This patent application is a continuation-in-part application under 37 C.F.R. Section 1.53(b)(2) of patent application having Ser. No. 11/212,459 filed Aug. 25, 2005, now abandoned and parent patent application having Ser. No. 10/712,727 filed Nov. 12, 2003, now abandoned.

BACKGROUND OF THE INVENTION

1. Technical Field

The present invention relates to sanitation covers. More specifically, the present invention relates to methods and apparatus for a single-use, disposable sanitation cover comprised of a flexible-elastic, stretchable, transparent material impregnated with an anti-bacterial compound for enclosing any of a plurality of shared electronic remote control devices for minimizing the transfer of bacteria and viruses from one user to another user by providing a disposable, protective sanitation barrier to human infection.

2. Background Art

Electronic remote control devices are now commonly utilized in our society including, for example, remote control devices utilized in our respective residences for use with television, radio and entertainment systems, garage door openers, security alarm activation devices and the like. In addition, electronic remote control devices are also utilized in quasi-public domains such as hotels, motels, restaurants and social clubs generally frequented by members of the public. Those electronic remote control devices utilized in our residences are generally accessible to a limited number of persons, i.e., not the public-at-large. Thus, limiting who handles and utilizes these residential electronic remote control devices can be generally regulated. However, electronic remote control devices typically encountered in, for example, a hotel/motel room are handled by most all persons utilizing that particular hotel/motel room including domestic workers. Such common usage of, for example, a television remote control device found in a hotel/motel room provides an excellent vehicle for the transfer of bacteria and/or viruses from a first person handling the commonly-shared remote control device to a second or subsequent person.

Remote control devices are available in many different shapes and sizes. However, each includes an outer housing typically comprised of plastic and having, for example, a shape that can be rectangular, square, oblong or the like. Further, a typical remote control device includes a front surface and a rear surface where the front surface is characterized by a keypad exhibiting a plurality push buttons and the rear surface includes a compartment for housing a plurality of batteries. The interior of the outer housing includes a combination of electronic circuitry that generates the various radio frequency (RF) signals and/or infrared signals that are transmitted to the base or host appliance such as, for example, a television receiver. Thus, operation of select push buttons on the keypad located on the front surface of the remote control device generates a particular unique signal for causing the television receiver to perform a specific function such as, for example, change channels. The enclosed batteries are employed for providing electrical energy to power the electronic circuitry contained within the outer housing.

Protective coverings for electronic devices have been known in the past. For example, U.S. Pat. No. 6,273,252 to Mitchell teaches a protective covering for a handheld device comprising a resilient, water-impermeable bag having a continuous smooth upper surface. U.S. Pat. No. 5,499,713 to Huffer teaches a transparent remote control flexible envelope having a rectangular shape and at least one closing web and gripper means for attaching the envelope to an armrest of a chair. U.S. Pat. No. 6,082,535 to Mitchell discloses a protective covering for a cell phone or pager having a latex construction while U.S. Pat. No. 5,316,141 to Jalomo teaches a remote control cover comprised of flexible polyvinyl chloride (PVC) material for protecting the remote control from spills and water. U.S. Pat. No. 6,050,407 to Trujillo teaches a remote control cover having a transparent sheath construction for enabling the operation of a keypad housed within the sheath and for protection from dirt. Further, U.S. Pat. Nos. 6,273,252 and 6,082,535 to Mitchell for a protective covering for a handheld device or a cell phone discloses a shrink wrap feature so that the protective covering fits all handheld devices or cell phones. U.S. Reissue Pat. No. 24,166 to Stiller (1956) teaches an elliptical, self-closing container having a slit on the top surface which functions as a change purse for carrying coins, keys and the like. Application of force to the two ends of the elliptical container causes the slit to open providing access to the interior of the container which is comprised of liquid plastic.

Additional prior art references include U.S. Pat. No. 6,471,056 to Tzeng which recites a portable electronic device protective cover having a loop-like plastic peripheral strip fitting the periphery of the electronic device to be protected, the loop-like periphery strip having an insertion slot through which the electronic device to be protected is inserted into the inside of the portable electronic device protective cover, a transparent plastic top panel peripherally sealed to the top side of the loop-like peripheral strip by a high frequency heat sealing apparatus, and a transparent plastic bottom panel peripherally sealed to the bottom side of the loop-like peripheral strip by a high frequency heat sealing apparatus. The Tzeng '056 reference specifically recites that the protective cover " . . . fits perfectly the shape of the portable electronic device to be protected" and that " . . . protective cover 3 is made subject to a mold 4, which is an open frame fitting the height and width of the remote-controller 2 to be protected." Thus, the Tzeng '056 protective cover appears to be custom manufactured for each remote-controller 2 and not designed to conform to the shape of most any size remote-controller 2. Further, the Tzeng '056 protective cover is intended to protect the remote-controller 2 and not the user of the remote-controller 2. There is no mention in Tzeng '056 of providing a disposable, protective sanitation barrier to human infection or impregnation of the cover with an anti-bacterial compound. Tzeng '056 teaches assembling the components of the protective cover 3 with a high frequency heat sealing machine and cutting away excess material outside the seal area. The processes of high frequency heat sealing and cutting away excess material typically results in the formation of seams and thus would not appear to provide an integrally molded, seamless, unitary one-piece construction.

Additionally, U.S. Pat. No. 4,901,852 to King for a Protective Cover For A Pager, and U.S. Pat. No. 6,634,494 to Derr et al. for Watertight Protective Device For Holding A Measuring Or Display Device are mentioned herein. King '852, Derr et al. '494 and Tzeng '056 each disclose devices that are intended to protect an electronic or measuring device, do not provide a sanitation barrier to human infection, do not disclose an impregnation of an anti-bacterial compound, and are not directed to single-use, seamless, disposable protective covers.

Thus, there is a need in the art for a cover for a remote control device that provides a protective barrier to human infection having front and rear members that are integrally molded in a seamless, unitary one-piece construction to form a single-use, disposable, protective enclosure, an orifice formed in and parallel to an oblong dimension of the rear member for enabling most any size remote control device which is one of a plurality of various sized remote control devices to be inserted into and removed from the single-use protective enclosure, the disposable cover being comprised of a flexible, stretchable and transparent material for conforming to the shape of the remote control device and being impregnated with an anti-bacterial compound for providing a disposable, protective sanitation barrier to human infection, the disposable cover being refitted regularly to minimize the transfer of bacteria and viruses from a previous user to a subsequent user of the remote control device.

DISCLOSURE OF THE INVENTION

Briefly, and in general terms, the present invention provides a new and improved cover for a remote control device for creating a convenient, disposable cover primarily for providing a protective barrier to human infection by enclosing any of a plurality of electronic remote control devices typically shared among many persons. The single-use, disposable cover for a remote control device serves to minimize the transfer of bacteria and viruses from one person who uses the remote control device to another, i.e., the disposable cover provides a protective sanitation barrier to human infection. In particular, the inventive disposable cover for a remote control device is impregnated with an anti-bacterial compound for facilitating the protective sanitation barrier and is comprised of a flexible-elastic, transparent material fashioned so as to easily conform to the shape of most any size remote control device. Further, the flexible-elastic transparent material facilitates the capture of the remote control device within the fabric of the cover. Likewise, the cover can be easily removed from the remote control device.

In general, the disposable cover for remote control device comprises a sheath-like or pouch-like enclosure that includes a rear member integrally formed with a front member at a plurality of rounded surfaces. An orifice or opening is formed in the rear member of the cover for facilitating the insertion and removal of a remote control device which is one of a plurality of various sized remote control devices. The front member typically exhibits a continuously curved surface. However, the shape of the rear member is flat. The inventive cover is available in at least two different shapes. The plurality of rounded surfaces that integrally join the front member with the rear member enable the flexible-elastic material from which the disposable cover is fashioned to partially relax once the cover is fitted onto the remote control device. This relaxation of the flexible-elastic material enables the orifice to close upon itself ensuring that the cover substantially encloses the remote control device.

The cover exhibits an integrally molded, seamless, unitary one-piece construction and can be comprised of, for example, a latex based material or polyurethane compound but many other suitable materials are also available. The selected material is flexible, elastic, i.e., stretchable, and thus quickly adopts or conforms to the shape of most any size remote control device of a plurality of various sized remote control devices. Thus, once fitted, the cover snugly fits over an outer housing of the remote control device. A typical remote control device, whether used for a television, stereo system, hospital bed control or other manual electronic control device, includes a control keypad. Manipulation of the keys mounted on the keypad facilitates the control of the specific electronic device. The selected material from which the cover is fashioned is also transparent. Thus, once fitted onto the remote control device, the transparent nature of the inventive cover facilitates unimpeded operation of the keys mounted on the keypad. The inventive cover for the remote control device serves several functions. Since the remote control device is typically shared between, i.e., handled by, several persons, the cover functions to provide a disposable, protective sanitation barrier to human infection by preventing the transfer of bacteria and viruses between individuals. The material comprising the disposable cover is impregnated with an anti-bacterial compound for facilitating the protective sanitation barrier. Thus, in a quasi-public setting as in a hotel or motel environment, the disposable cover would normally be changed daily along with, for example, the bed sheets. In a domestic setting, the cover could be cleaned regularly with a suitable disinfecting cleaner product. A secondary feature is that the cover also serves to protect the electronic circuitry of the remote control device from dirt, soil, spills and grime. However, the inventive cover primarily establishes a disposable, protective sanitation barrier to human infection by protecting primarily the plurality of users of the remote control device but as an additional feature also serves to protect the electronic circuitry housed within the remote control device.

In a preferred embodiment, the disposable cover for use with the remote control device for providing a protective sanitation barrier to human infection in its most fundamental form comprises a rear member having a flat surface. A front curved member is integrally molded in a seamless unitary, one-piece construction with the rear member at a plurality of rounded surfaces to form a single-use, disposable protective enclosure. An anti-bacterial compound impregnates the rear member, the front curved member and the rounded surfaces for destroying bacteria on the remote control device. An orifice is formed in the rear member for enabling the remote control device to be inserted into and removed from the enclosure. Finally, the front member, rear member and the rounded surfaces are comprised of a flexible, stretchable and transparent material for conforming to the shape of the remote control device for providing a disposable, protective sanitation barrier to human infection.

In an alternative embodiment, the disposable cover for use with the remote control device for providing a protective barrier to human infection also comprises a front member having a generally continuous flat surface and a rear member having a rectangular surface. The rear member is also integrally molded in a seamless unitary, one-piece construction with the front member at a plurality of rounded surfaces for forming a single-use, disposable protective enclosure. An anti-bacterial compound impregnates the rear member, the front member, and the rounded surfaces for destroying bacteria on the remote control device. An orifice is formed in the rectangular surface of the rear member for enabling most any size remote control device to be inserted into and removed from the enclosure. The rounded surfaces facilitate the closing of the orifice for enclosing the remote control device. The disposable cover of the alternative embodiment in addition to being impregnated with an anti-bacterial compound is comprised of a flexible, stretchable and transparent material for conforming to the shape of the remote control device for providing a disposable, protective sanitation barrier to human infection.

These and other objects and advantages of the present invention will become apparent from the following more detailed description, taken in conjunction with the accompanying drawings which illustrate the invention, by way of example.

DETAILED DESCRIPTION OF THE INVENTION

The present invention is a disposable cover 100 for use with a remote control device 102 for providing a protective sanitation barrier to human infection and which provides a convenient, single-use, disposable cover for enclosing any of a plurality of electronic remote control devices typically utilized by a plurality of persons. The remote control device 102 can be utilized, for example, to control a television, stereo system, hospital bed or other manual electronic control apparatus.

The inventive cover 100 serves primarily to provide a disposable, protective sanitation barrier to human infection by minimizing the transfer of bacteria and viruses between persons who contact the remote control device 102 during usage. This is accomplished by impregnating the disposable cover 100 with an anti-bacterial compound 103 for destroying bacteria resident on the remote control device 102. In addition to the primary function of providing a sanitation barrier, the disposable cover 100 also serves a secondary function of protecting the remote control device 102 from dirt, spills, soil and grime. Thus, the inventive cover 100 establishes the disposable, protective sanitation barrier primarily to protect the multiple users of the remote control device 102 from infections that can be transferred by contact. The electronic circuitry (not shown) housed within the remote control device 102 is also protected as a secondary feature. The inventive disposable cover 100 is comprised of a flexible-elastic, stretchable, transparent material that (a) quickly conforms to or adopts the shape of most any size remote control device 102 of a plurality of various sized remote control devices, and (b) facilitates the capture and release of the remote control device 102 as it relates to the cover 100. Although the disposable cover 100 of the present invention is disclosed herein for use with the remote control device 102, it should be noted that the utility of the disposable cover 100 is not limited thereto. The present invention has applications to many other electronic devices including, but not limited to, portable telephone apparatus.

Figure 1:
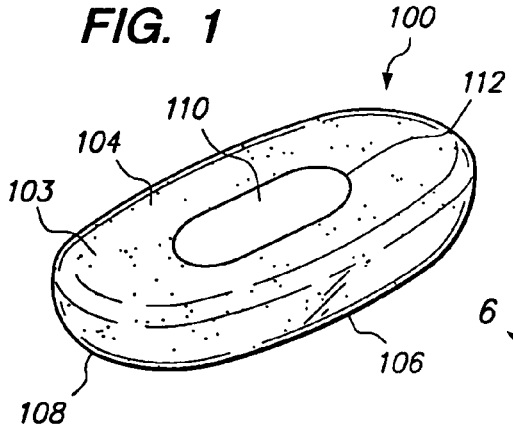
FIG. 1 is a rear perspective view of a cover for remote control device of the preferred embodiment of the present invention showing a rear flat surface with an orifice formed therein, the cover for providing a disposable, protective sanitation barrier to human infection.
Figure 2:
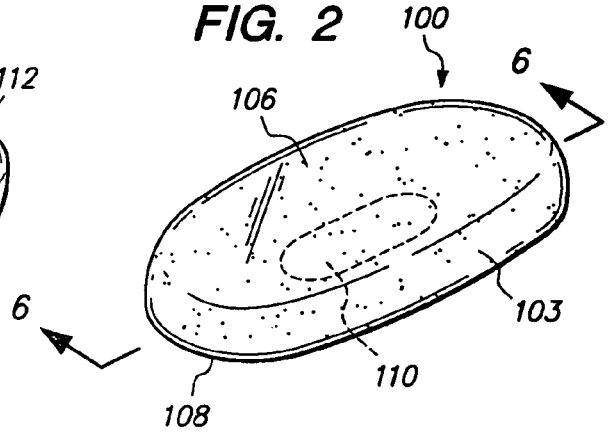
FIG. 2 is a front perspective view of the cover for remote control device of FIG. 1 showing a front curved surface including the orifice formed in the rear flat surface, shown in phantom.
Figure 3:
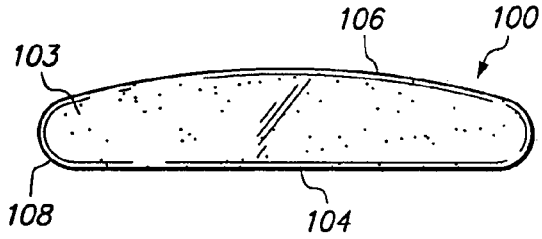
FIG. 3 is a right side elevation of the cover for remote control device of FIG. 2 showing the rear flat surface on the bottom and the front curved surface on the top of the view, a left side elevation being a mirror image thereof.
Figure 4:
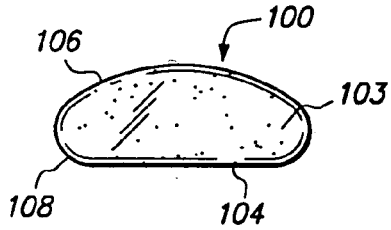
FIG. 4 is an end view of the cover for remote control device of FIG. 2 showing both the rear flat surface on the bottom and the front curved surface on the top of the view.
Figure 7:
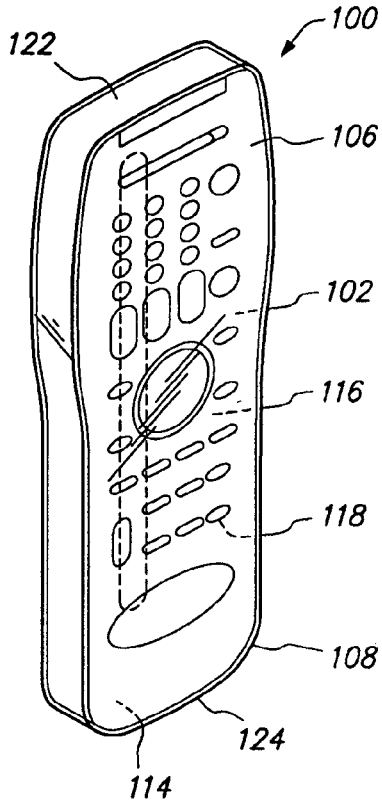
FIG. 7 is a front perspective view of the cover for remote control device of FIG. 1 shown mounted upon an oblong remote control device, a keypad of the remote control device being visible through the front curved surface of the cover.
Figure 8:
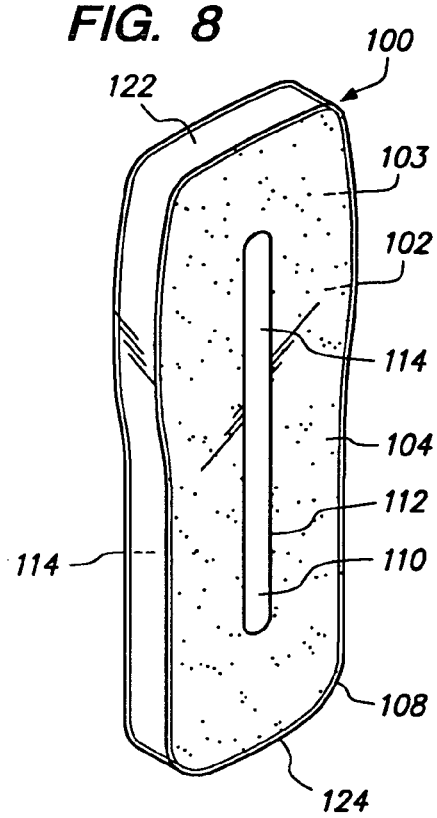
FIG. 8 is a rear perspective view of the cover for remote control device of FIG. 1 shown mounted upon an oblong remote control device, a rear surface of the remote control device being visible through the orifice formed in the rear flat surface of the cover.
Figure 9:
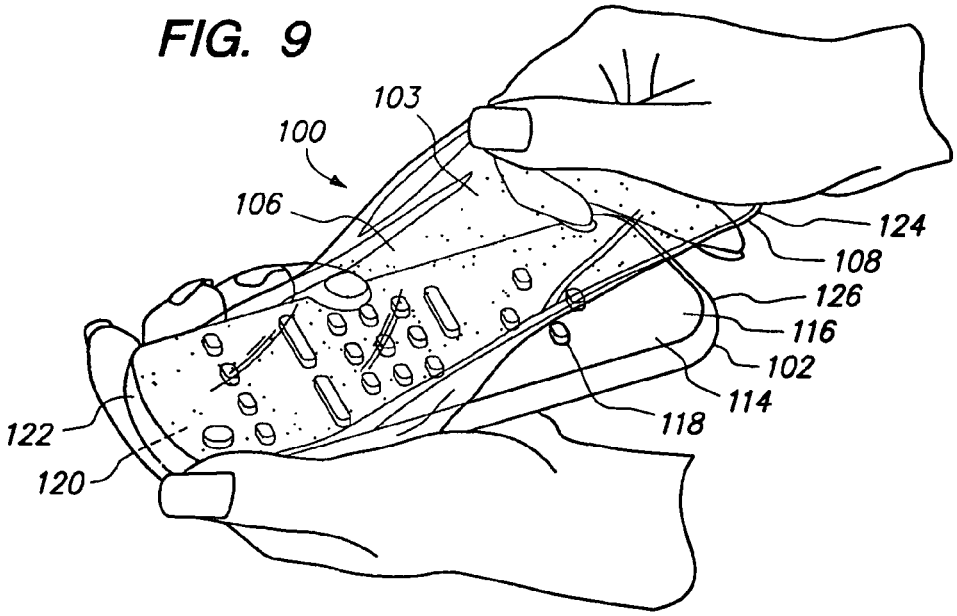
FIG. 9 is a perspective view of the cover for remote control device of FIG. 1 showing the cover being fitted over the oblong remote control device and illustrating the flexible-elastic and transparent nature of the cover, the keypad of the remote control device being visible through the front curved surface of the cover.

A preferred embodiment of the disposable cover 100 of the present invention will now be described in detail. The disposable cover 100 is illustrated in FIGS. 1-6 while the cover 100 in association with the remote control device 102 is illustrated in FIGS. 7-9. Turning our attention to FIGS. 1-6, the disposable cover 100 comprises a sheath-like or pouch-like enclosure that includes a rear member 104 and a front member 106 as is shown in FIGS. 1 and 2. The rear member 104 is integrally joined as by molding with the front member 106 at a plurality of rounded surfaces 108 best shown in FIGS. 3 and 4 to provide the disposable cover 100 with an integral, seamless, unitary, one piece construction. As is clearly shown in FIG. 1, the rear member 104 exhibits a rear flat surface which is functional as will be explained herein below. However, the shape of the front member 106 can vary depending upon the shape of the remote control device 102 for which the disposable cover 100 is intended to be used. In the preferred embodiment illustrated in FIGS. 1-6, the front member 106 has a continuously curved surface which exhibits an oblong dimension as is best shown in FIGS. 2, 3 and 6. The front member 106 having the oblong dimension along the curved surface is integrally formed with the rear member 104 having the flat surface at the plurality of rounded surfaces 108. This construction forms the sheath-like or pouch-like enclosure illustrated in FIG. 2 which provides a single-use, disposable protective enclosure.

These components will hereinafter be referred as to the rear flat member 104 and the front curved member 106 for clarity.

Figure 5:
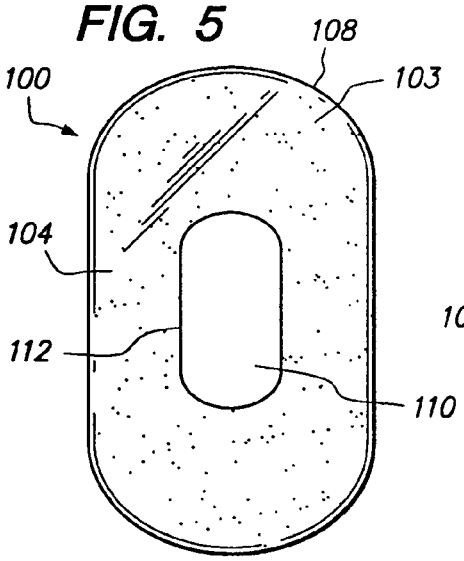
FIG. 5 is a rear planar view of the cover for remote control device of FIG. 1 showing the orifice formed within the rear flat surface.
Figure 6:
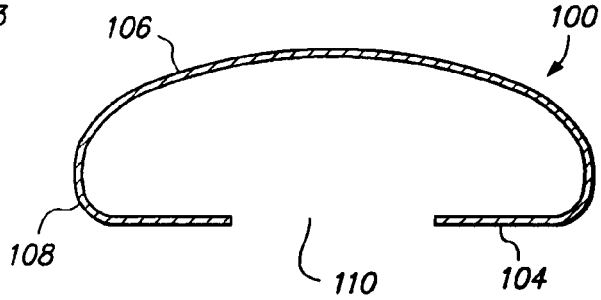
FIG. 6 is a cross-sectional view of the cover for remote control device of FIG. 2 taken along the line 6-6 of FIG. 2 showing the orifice formed in the rear flat surface.

An orifice 110 is formed in the flat surface of the rear flat member 104 as is clearly shown in FIGS. 1, 5 and 6. The orifice 110 provides an opening in the rear flat member 104 for enabling most any size remote control device 102 (which is one of a plurality of various sized remote control devices) to be inserted into and removed from the disposable cover 100. The orifice 110 as illustrated in FIGS. 1, 2, 5 and 8 is a rectangular or oval opening that has been determined to be the best orientation for the disposable cover 100 of the preferred embodiment. When the disposable cover 100 is fitted over a remote control device 102, the orifice 110 appears as a long narrow opening as best shown in FIG. 8. This determination is based upon an evaluation of several factors including the preferred construction material as will be discussed herein below.

Further, the orifice 110 is positioned parallel to the oblong dimension of the flat surface of the rear flat member 104 (see FIGS. 1 and 5) which has been determined to be the most convenient entry and exit point for the remote control device 102. However, it should be pointed out that the shape and position of the orifice 110 can be modified and the inventive cover 100 will still function as intended. For example, the orifice 110 could be a slit, gap, or aperture and could be repositioned on the front curved member 106 in, for example, a diagonal fashion. Further, the orifice 110 could also be located in the front curved member 106 parallel to the oblong dimension or in the rounded surfaces 108, if necessary, but would not operate as efficiently as disclosed in the preferred embodiment. The orifice 110 includes an edge or lip 112 as is shown in FIGS. 1, 5 and 8. It is noted that the lip 112 of the orifice 110 could be reinforced. However, through experimentation, it has been determined that the lip 112 need not be reinforced in order to retain the shape of the orifice 110.

Once the inventive disposable cover 100 is fitted over the remote control device 102 (i.e., the remote control device 102 is inserted into the cover 100 through the orifice 110), it is desirable that the orifice 110 close as shown in FIG. 8. Under these conditions, the remote control device 102 would be substantially enclosed by the cover 100 and physical contact therewith would be minimized if not eliminated. The disposable cover 100 including the plurality of rounded surfaces 108 is comprised of the flexible-elastic, stretchable material. The rounded surfaces 108 are the components of the inventive cover 100 which enable the rear flat member 104 to be integrally joined to the front curved member 106. Once the disposable cover 100 is fitted over the remote control device 102, the rounded surfaces 108 enable the flexible-elastic, stretchable material to partially relax. This relaxation of the flexible-elastic material enables the orifice 110 to close upon itself ensuring that the disposable cover 100 substantially encloses the remote control device 102. Thus, the rounded surfaces 108 designed into the cover 100 facilitate the closing of the orifice 110 for enclosing the remote control device 102. Therefore, an individual handling the inventive cover 100 once fitted in position, is not likely to contact the remote control device 102.

The disposable cover 100 including the rear flat member 104, front curved member 106 and the plurality of rounded surfaces 108 exhibits an integrally molded, seamless, unitary one-piece construction and can be comprised of, for example, a latex based material or polyurethane compound but many other suitable materials are also available. The latex based material or polyurethane compound have been selected as a preferred material since they readily conform to the shape of the remote control device 102, are flexible, elastic, stretchable and transparent, and are strong notwithstanding the presence of the orifice 110. Besides the latex based material and polyurethane compound, the cover 100 can also be comprised of, for example, polyvinyl chloride, nitrile rubber, silicon, neoprene, or styrenic elastomer. Each of these alternative materials enumerated immediately above also is flexible, elastic, i.e., stretchable, and transparent and thus quickly adopts or conforms to the shape of the remote control device 102. Thus, once fitted, the disposable cover 100 snugly fits over an outer housing 114 (see FIG. 9) of the remote control device 102. Thus, the disposable cover 100 is not custom sized to any specific remote control device 102.

Remote control devices 102 are available in a variety of shapes and sizes depending upon the number of circuits housed therein and the physical layout of a control keypad 116 incorporated therein. A typical remote control device 102, whether used for a television, stereo system, hospital bed control or other manual electronic control device, includes the control keypad 116 as shown in FIGS. 7 and 9. Manipulation of a plurality of keys 118 mounted on the control keypad 116 facilitates the control of the specific electronic device with which the remote control device 102 is intended to be used. The appearance of any particular remote control device 102 can vary, i.e., for example, some remote control devices 102 are rectangular while others are oblong in shape. However, the control keypad 116 is typically planar in shape to facilitate its installation. Consequently, the utility of the continuously curved surface of the front curved member 106 of the inventive disposable cover 100 is that it enables the front curved member 106 to closely hug the surface of the control keypad 116.

The selected material from which the disposable cover 100 is fashioned, i.e., the latex based material or the polyurethane compound in the preferred embodiment, is transparent in addition to being flexible, elastic and stretchable. Thus, once fitted onto the remote control device 102, the transparent nature of the inventive cover 100 facilitates unimpeded operation of the plurality of keys 118 mounted on the control keypad 116. Therefore, the continuously curved surface of the front curved member 106 and the transparent nature of the inventive disposable cover 100 assists the user in operating the plurality of keys 118 located on the control keypad 116 as shown in FIGS. 7 and 9. Further, the appearance of the inventive cover 100 when fitted upon the remote control device 102 is determined by (a) the shape of the remote control device 102, i.e., for example, rectangular versus oblong, and (b) the material selected from which the disposable cover 100 is formed.

The inventive disposable cover 100 is shown being fitted onto the remote control device 102 in FIG. 9. The remote control device 102 is securely held in, for example, the left hand while the inventive cover 100 (as shown in FIG. 2) is aligned therewith with the right hand (see FIG. 9). The remote control device 102 is extended through the orifice 110 shown underneath in FIG. 2. The cover 100 is then wrapped about an upper end 120 of the outer housing 114 of the remote control device 102 as is shown in FIG. 9. With a top end 122 of the disposable cover 100 anchored upon the upper end 120 of the outer housing 114, a bottom end 124 of the flexible-elastic cover 100 is stretched downward to a lower end 126 of the remote control device 102. This action stretches the flexible-elastic cover 100 and opens the orifice 110 in the rear flat member 104 enabling the remote control device 102 to be surrounded by the cover 100. Once the disposable cover 100 surrounds the remote control device 102, the bottom end 124 of the cover 100 is anchored around the lower end 126 of the outer housing 114 of the remote control device 102. The bottom end 124 of the cover 100 is then released. Thereafter, the flexible-elastic cover 100 contracts and the plurality of rounded surfaces 108 enable the front curved member 106 of the cover 100 to partially relax. This action causes the lip 112 of the orifice 110 on the rear flat member 104 to close so that the remote control device 102 is substantially covered as is shown in FIG. 8. The continuously curved surface of the front curved member 106 is shown closely hugging the surface of the control keypad 116 of the remote control device 102 in FIG. 7. This close fitting feature in combination with the transparency of the cover 100 facilitates the operation of the plurality of keys 118 on the control keyboard 116. Removal of the disposable cover 100 is accomplished by reversing the order of the steps set forth in the this paragraph.

The inventive disposable cover 100 for the remote control device 102 serves several functions. Since the remote control device 102 is typically shared between, i.e., handled, by several persons, the single-use, disposable cover 100 functions to provide a disposable, protective sanitation barrier to human infection by preventing the transfer of bacteria and viruses between individuals. This feature is accomplished in the following manner. The latex based material or polyurethane compound comprising the disposable cover 100 including the rear flat member 104, front curved member 106, and plurality of rounded surfaces 108 is impregnated with the anti-bacterial compound 103 for facilitating the protective sanitation barrier as shown in FIGS. 1-6 and 8. A suitable example of the anti-bacterial compound 103 can be, for example, a compound known as a Styrene-Ethylene-Butylene (Ethylene)-Styrene Copolymer compound. Further, the compound from which the disposable cover 100 for a remote control device 102 including the rear flat member 104, front curved member 106 and plurality of rounded surfaces 108 is identified in the relevant art as being of Compound Grade SR-9000RT. The anti-bacterial compound 103 such as the Styrene-Ethylene-Butylene (Ethylene)-Styrene Copolymer compound is impregnated into the disposable cover 100 which is preferably of Compound Grade SR-9000RT in the following injection molding procedure.

The Grade SR-9000RT compound of which the disposable cover 100 is comprised is inserted into an injection molding machine (not shown) in the presence of the anti-bacterial compound 103, i.e., the Styrene-Ethylene-Butylene (Ethylene)-Styrene Copolymer compound. The combination of the Grade SR-9000RT compound of the disposable cover 100 and the anti-bacterial compound 103 are then melted together. The melted combination is then injected into a mold (not shown) of the disposable cover 100 through a nozzle (not shown). Once the molding procedure has been completed, the molded disposable cover 100 now comprised of the combination of the Grade SR-9000RT and the anti-bacterial compound 103 is retrieved from the mold. The molded disposable cover 100 now exhibits anti-bacterial properties.

Several of the characteristics of the latex based material or polyurethane compound (Grade SR-9000RT plus the anti-bacterial compound 103) from which the disposable cover 100 is fashioned are transparency, stretchability, tensile strength and tackiness. The transparency feature refers to clarity and in the present invention, the disposable cover 100 is clear, not cloudy or milky colored, that is, without color distortion. The tensile strength refers to tearing or shearing of the latex based material or polyurethane compound comprising the disposable cover 100. The tensile strength of the disposable cover 100 is high to resist tearing. The tensile strength of the disposable cover 100 has a rating or coefficient of "700" which means that the disposable cover 100 will stretch up to seven times its original dimensions, i.e., relaxed state, before the material fails. This characteristic maximizes the flexibility, elasticity and stretchability of the disposable cover 100 when used as intended. Finally, the material comprising the disposable cover 100 including the anti-bacterial compound 103 exhibits a minimum of tackiness or stickiness to the touch for providing a non-sticky surface.

Thus, in a quasi-public setting such as in a hotel or motel environment, the disposable cover 100 would normally be changed daily along with, for example, the bed sheets. Thus, the inventive cover 100 is a disposable item (see FIG. 9) that could be purchased in bulk by members of, for example, the hospitality industry. Consequently, the cover 100 is intended to be primarily a single-use, disposable protective enclosure which conforms to the shape of the remote control device 102 and to provide a conveniently replaceable sanitation barrier to human infection. In a domestic setting, the disposable cover 100 could be cleaned regularly with a suitable disinfecting cleaner product. The disposable cover 100 also serves a secondary function of protecting the electronic circuitry within the remote control device 102 from dirt, soil, spills and grime. However, the inventive cover 100 primarily establishes a disposable, protective sanitation barrier to human infection by protecting primarily the plurality of users of the remote control device 102. However, as an additional feature, the inventive disposable cover 100 also serves to protect the electronic circuitry housed within the remote control device 102. Additionally, the inventive cover 100 also serves to prevent the loss of a battery compartment cover (not shown)mounted on the remote control device 102 when the cover 100 is fitted thereon.

As disclosed in the preferred embodiment, the disposable cover 100 for use with the remote control device 102 for providing a protective barrier to human infection includes the rear member 104 having a flat surface and the front curved member 106 that is integrally molded in a seamless unitary, one-piece construction with the rear flat member 104 at the plurality of rounded surfaces 108 to form the single-use, disposable protective enclosure. The anti-bacterial compound 103 impregnates the rear flat member 104, the front curved member 106 and the rounded surfaces 108 for destroying bacteria on the remote control device 102. Finally, the orifice 110 formed in the rear flat member 104 enables the remote control device 102 to be inserted into and removed from the disposable protective enclosure. The front curved member 106, rear flat member 104 and the rounded surfaces 108 are comprised of a flexible, stretchable and transparent material for conforming to the shape of the remote control device 102 for providing a disposable, protective sanitation barrier to human infection.

An alternative embodiment of the cover for use with a remote control device is shown in FIGS. 10-14 and is referred to by the identification number 200. Each of the components appearing in the alternative embodiment 200 that correspond in structure and function to those components appearing in the preferred embodiment 100 is identified by the corresponding number of the 200 series.

The components appearing in the alternative embodiment of the inventive cover 200 for use with a remote control device that correspond in structure and function to those components appearing in the preferred embodiment 100 will be set forth at this time. Those components include a rear member 204 having a flat surface, a front member 206 having a flat rectangular surface, a plurality of rounded surfaces 208, i.e., radiused round edges, employed to integrally join as by molding the rear member 204 with the front member 206 to provide a seamless, unitary, one-piece construction to form a single-use disposable protective enclosure. The rear member 204, front member 206 and plurality of rounded surfaces 208 are each impregnated with an anti-bacterial compound 203. Also included is an orifice 210 used for the insertion and removal of most any size remote control device (of a plurality of various sized remote control devices) into and from the disposable cover 200, an edge or lip 212 of the orifice 210, and a top end 222 and a bottom end 224, each of the inventive cover 200. Certain components included in the alternative embodiment 200 are identical to those disclosed in the preferred embodiment and continue to be identified by their assigned numbers of the 100 series as illustrated in FIGS. 7, 8 and 9. Those components include a remote control device 102, an outer housing 114, a control keypad 116 including a plurality of keys 118, and an upper end 120 and a lower end 126, each of the remote control device 102.

Many of the characteristic features of the inventive cover 200 are the same as those disclosed in the preferred embodiment 100. For example, the cover 200 exhibits an integrally molded, seamless, unitary one-piece construction comprised of a flexible-elastic, stretchable and transparent material. The orifice 210 continues to be located on the rear member 204 for facilitating the fitting of most any size disposable cover 200 onto the remote control device 102. The plurality of rounded surfaces 208, i.e., radiused round edges, continue to enable the front member 206 (once fitted onto the remote control device 102) to partially relax so that the orifice 210 will close. Further, the inventive cover 200 continues primarily to provide a single-use, disposable protective enclosure to prevent the transfer of bacteria and viruses between individuals using a common remote control device 102 for providing a disposable, protective sanitation barrier to human infection. A secondary feature is to protect the electronic circuitry of the remote control device 102 from dirt, soil, spills and grime. Thus, as with the preferred embodiment 100, the inventive disposable cover 200 establishes the protective sanitation barrier to primarily protect the plurality of users of the remote control device 102, and secondarily the electronic circuitry housed within the remote control device 102. Additionally, the inventive cover 200 also serves to prevent the loss of a battery compartment cover (not shown) mounted on the remote control device 102 when the cover 200 is fitted thereon.

Figure 10:
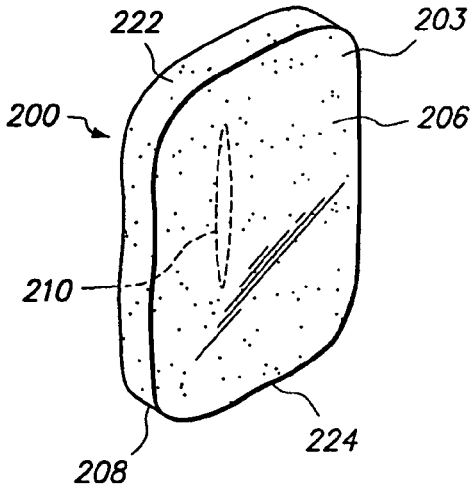
FIG. 10 is a front perspective view of a first alternative embodiment of the cover for remote control device of the present invention showing a front flat surface, with an orifice formed in a rear surface and shown in phantom, the cover providing a disposable, protective sanitation barrier to human infection.
Figure 11:
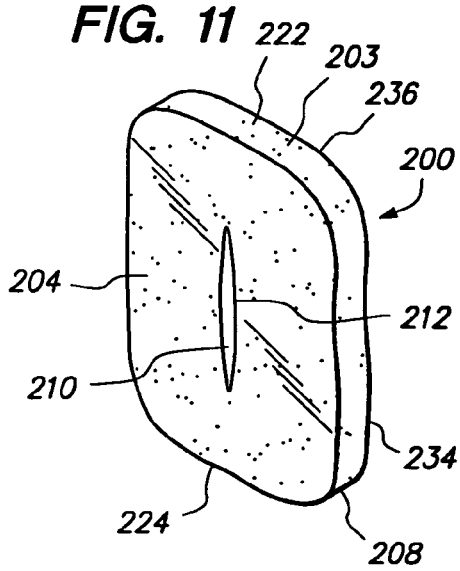
FIG. 11 is a rear perspective view of the cover for remote control device of FIG. 10 showing the rear surface of the cover with the orifice formed therein.
Figure 12:
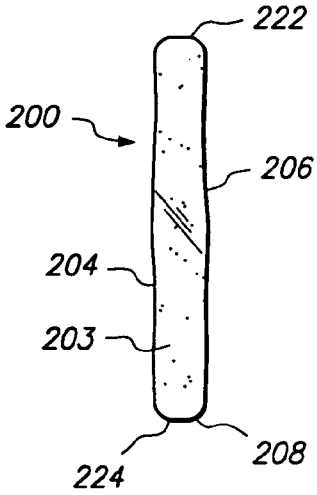
FIG. 12 is a left side elevation of the cover for remote control device of FIG. 10 showing a side connecting the front flat surface and the rear surface, a right side elevation being a mirror image thereof.
Figure 13:
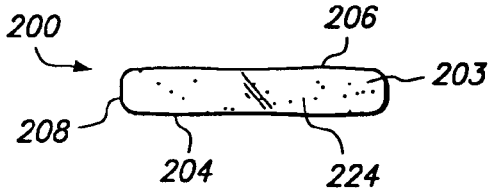
FIG. 13 is an end view of the cover for remote control device of FIG. 10 showing the front flat surface at the top of the view and the rear surface at the bottom of the view.

Turning our attention to FIGS. 10-14, the disposable cover 200 comprises a sheath-like or pouch-like enclosure that includes the front member 206 and the rear member 204 as is shown in FIGS. 10 and 11, respectively. The front member 206 is integrally joined as by molding with the rear member 204 at the plurality of rounded surfaces 208, i.e., radiused round edges, best shown in FIGS. 12 and 13 to provide the cover 200 with an integrally molded, seamless, unitary one piece construction. As is clearly shown in FIG. 10, the front member 206 exhibits a continuously flat surface which, as in the preferred embodiment 100, is functional in providing visual communication with the remote control device 102. In the alternative embodiment 200 illustrated in FIGS. 10-14, the rear member 204 has a rectangular surface which is also substantially flat as is best shown in FIGS. 11, 12 and 13. The rear member 204 having the rectangular surface which is substantially flat, i.e., a substantially flat rectangular surface, is integrally joined with the front member 206 having the continuously flat surface at the plurality of rounded surfaces 208, i.e., radiused round edges, to provide a single-use, disposable protective enclosure. This construction forms the sheath-like or pouch-like enclosure illustrated in FIGS. 10 and 11 for providing a disposable, protective sanitation barrier to human infection.

Figure 14:
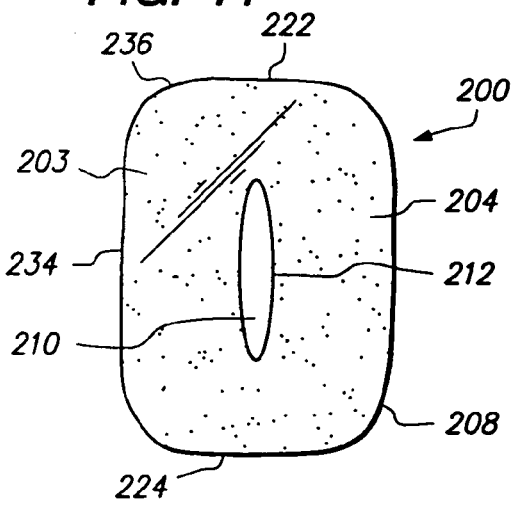
FIG. 14 is a rear plan view of the cover for remote control device of FIG. 11 showing the orifice formed vertically in the rear surface thereof.

The orifice 210 is formed in the flat rectangular surface of the rear member 204 as is clearly shown in FIGS. 10, 11 and 14. The orifice 210 provides an opening in the rear member 204 for enabling most any size remote control device 102 (of a plurality of various sized remote control devices) to be inserted into and removed from the cover 200. The orifice 210 as illustrated best in FIGS. 11 and 14 is a long narrow opening or oval that has been determined to be the best orientation for the cover 200. This determination is based upon an evaluation of several factors including the preferred construction latex based material or a polyurethane compound. It is noted that the rectangular surface of the rear member 204 includes a long dimension 234 and a short dimension 236 as is best shown in FIG. 14. In the illustration of FIG. 14, the orifice 210 is positioned parallel to the long dimension 234 of the rear member 204 which has been determined to be the most convenient entry and exit point for the remote control device 102. However, it should be pointed out that the shape and position of the orifice 210 can be modified and the inventive cover 200 will still function as intended. For example, the orifice 210 could be a slit, gap, or aperture and could be repositioned on the rear member 204. Additionally, the orifice 210 can be a narrow opening or oval positioned parallel to the short dimension 236 in either the bottom end 224 of the rear member 204 or the top end 222 of the rear member 204. Finally, the orifice 210 could also be located in the front member 206 or in the rounded surfaces 208, if necessary, but would not operate as efficiently as disclosed herein. The orifice 210 also includes an edge or lip 212 as is shown in FIGS. 11 and 14. It is noted that the lip 212 of the orifice 210 could be reinforced. However, through experimentation, it has been determined that the lip 212 need not be reinforced in order to retain the shape of the orifice 210.

Once the inventive disposable cover 200 is fitted over the remote control device 102 (i.e., the remote control device 102 is inserted into the cover 200 through the orifice 210), it is desirable that the orifice 210 close as shown in FIG. 11. Under these conditions, the remote control device 102 would be substantially enclosed by the disposable cover 200 and physical contact therewith would be minimized if not eliminated. The disposable cover 200 including the plurality of rounded surfaces 208, i.e., radiused round edges, is comprised of the flexible-elastic and stretchable material. The rounded surfaces 208 are the components of the inventive disposable cover 200 which enable the front member 206 to be integrally joined to the rear member 204 in an integrally molded, seamless, unitary one-piece construction. Once the cover 200 is fitted over the remote control device 102, the rounded surfaces 208 enable the flexible-elastic and stretchable material to partially relax. This relaxation of the flexible-elastic material enables the orifice 210 to close upon itself ensuring that the disposable cover 200 substantially encloses the remote control device 102. Thus, the rounded surfaces 208 designed into the disposable cover 200 facilitate the closing of the orifice 210 for enclosing most any size remote control device 102. Therefore, an individual handling the inventive cover 200, once fitted in position, is not likely to contact the remote control device 102.

As with the preferred embodiment 100, the disposable cover 200 including the front member 206, rear member 204 and plurality of rounded surfaces 208 exhibits an integrally molded, seamless, unitary one-piece construction and can be comprised of, for example, a latex based material or a polyurethane compound but many other suitable materials are also available. Besides the latex based material and polyurethane compound, the cover 200 can also be comprised of, for example, polyvinyl chloride, nitrile rubber, silicon, neoprene, or styrenic elastomer. The selected material which can include any of those materials enumerated herein is flexible, elastic, i.e., stretchable, and transparent and thus quickly adopts or conforms to the shape of most any remote control device 102. Thus, once fitted, the cover 200 snugly fits over the outer housing 114 (see FIG. 9) of the remote control device 102 for providing a disposable, protective sanitation barrier to human infection.

The inventive disposable cover 200 for the remote control device 102 serves several functions. Since the remote control device 102 is typically shared between, i.e., handled, by several persons, the single-use, disposable cover 200 functions to provide a disposable, protective sanitation barrier to human infection by preventing the transfer of bacteria and viruses between individuals. This feature is accomplished in the same manner that it was accomplished in the preferred embodiment. The latex based material or polyurethane compound comprising the disposable cover 200 including the rear member 204 having the flat rectangular surface, front member 206 having the continuous flat surface, and plurality of rounded surfaces 208 is impregnated with the anti-bacterial compound 203 for facilitating the protective sanitation barrier as shown in FIGS. 10-14. A suitable example of the anti-bacterial compound 203 can be, for example, a compound known as a Styrene-Ethylene-Butylene (Ethylene)-Styrene Copolymer compound. Further, the compound from which the disposable cover 200 for the remote control device 102 including the rear member 204 having the flat rectangular surface, front member 206 having the continuous flat surface, and plurality of rounded surfaces 208 is identified in the relevant art as being of Compound Grade SR-9000RT. The anti-bacterial compound 203 such as the Styrene-Ethylene-Butylene (Ethylene)-Styrene Copolymer compound is impregnated into the disposable cover 200 which is preferably of Compound Grade SR-9000RT in the following injection molding procedure.

The Grade SR-9000RT compound of which the disposable cover 200 is comprised is inserted into an injection molding machine (not shown) in the presence of the anti-bacterial compound 203, i.e., the Styrene-Ethylene-Butylene (Ethylene)-Styrene Copolymer compound. The combination of the Grade SR-9000RT compound of the disposable cover 200 and the anti-bacterial compound 203 are then melted together. The melted combination is then injected into a mold (not shown) of the disposable cover 200 through a nozzle (not shown). Once the molding procedure has been completed, the molded disposable cover 200 now comprised of the combination of the Grade SR-9000RT and the anti-bacterial compound 203 is retrieved from the mold. The molded disposable cover 200 now exhibits anti-bacterial properties.

Several of the characteristics of the latex based material or polyurethane compound (Grade SR-9000RT plus the anti-bacterial compound 203) from which the disposable cover 200 is fashioned are transparency, stretchability, tensile strength and tackiness. The transparency feature refers to clarity and in the present invention, the disposable cover 200 is clear, not cloudy or milky colored, that is, without color distortion. The tensile strength refers to tearing or shearing of the latex based material or polyurethane compound comprising the disposable cover 200. The tensile strength of the disposable cover 200 is high to resist tearing. The tensile strength of the disposable cover 200 has a rating or coefficient of "700" which means that the disposable cover 200 will stretch up to seven times its original dimensions, i.e., relaxed state, before the material fails. This characteristic maximizes the flexibility, elasticity and stretchability of the disposable cover 200 when used as intended. Finally, the material comprising the disposable cover 200 including the anti-bacterial compound 203 exhibits a minimum of tackiness or stickiness to the touch for providing a non-sticky surface.

The construction and operation of the remote control device 102 is identical to that described with regard to the preferred embodiment 100. Consequently, the utility of the continuously flat surface of the front member 206 of the inventive cover 200 is that it enables the front member 206 to closely hug the surface of the control keypad 116 of the remote control device 102. The selected material from which the cover 200 is fashioned, i.e., the latex based material or the polyurethane compound, is transparent in addition to being flexible, elastic and stretchable. Thus, once fitted onto the remote control device 102, the transparent nature of the inventive cover 200 facilitates unimpeded operation of the plurality of keys 118 mounted on the control keypad 116. Therefore, the continuously flat surface of the front member 206 and the transparent nature of the inventive disposable cover 200 assists the user in operating the plurality of keys 118 located on the control keypad 116 as shown in FIGS. 7 and 9. Further, the appearance of the inventive disposable cover 200 when fitted upon the remote control device 102 (as with the preferred embodiment 100) is determined by (a) the shape of the remote control device 102, i.e., for example, rectangular versus oblong, and (b) the material selected from which the cover 200 is formed. Finally, the procedure for inserting the remote control device 102 into and withdrawing it from the cover 200 is duplicate to that described with regard to the preferred embodiment 100.

As disclosed in the alternative embodiment, the disposable cover 200 for use with the remote control device 102 provides a protective barrier to human infection and comprises the front member 206 having a continuously flat surface and the rear member 204 having a flat rectangular surface. The rear member 204 is integrally molded in a seamless unitary, one-piece construction with the front member 206 at the plurality of rounded surfaces 208 to form the single-use, disposable protective enclosure. The anti-bacterial compound 203 impregnates the front member 206, the rear member 204 and the rounded surfaces 208 of the disposable cover 200 for destroying bacteria on the remote control device 102. The orifice 210 is formed in the rectangular surface of the rear member 204 for enabling the remote control device 102 to be inserted into and removed from the enclosure. The front member 206, the rear member 204 and the rounded surfaces 208 are comprised of a flexible, stretchable and transparent material for conforming to the shape of the remote control device 102 for providing a disposable, protective sanitation barrier to human infection. The rounded surfaces 208 facilitate the closing of the orifice 210 for enclosing the remote control device 102.

The present invention provides novel advantages over other covering devices known in the prior art. The main advantages of the inventive disposable cover 100 of the preferred embodiment are that (1) it creates an integrally molded, seamless, unitary, one-piece cover construction to form a disposable, protective, sanitation barrier to human infection to protect individual users of the remote control device 102 by effectively preventing the transfer of bacteria and viruses between users when regularly refitted, and (2) the rear member 104, front member 106 and plurality of curved surfaces 108 are each impregnated with an anti-bacterial compound 103 for destroying bacteria resident on the outer housing 114 of the remote control device 102. Other advantages of the inventive disposable cover 100 for use with the remote control device 102 include (3) forming the orifice 110 within and parallel to the oblong dimension of the rear member 104 to facilitate the insertion and removal of most any size remote control device 102 into and from the disposable cover 100, (4) providing the front member 106 with a transparent and continuously curved surface that assists in the visual operation of the control keypad 116, (5) providing the plurality of rounded surfaces 108 that enables the front member 106 to relax when fitted onto the remote control device 102 thus allowing the orifice 110 to close substantially covering the remote control device 102, (6) being fabricated from a flexible-elastic and stretchable material that facilitates insertion and removal of the disposable cover 100 onto the remote control device 102 which is one of a plurality of various sized remote control devices, (7) protecting the remote control device 102 from dirt, soil, spills and grime, and (8) preventing the loss of the battery compartment cover (not shown) mounted on the remote control device 102.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention.

Accordingly,

The invention claimed is:

1. A disposable cover for use with a remote control device for providing a protective barrier to human infection comprising:

a rear member having a flat surface;

a front curved member integrally molded in a seamless unitary, one-piece construction with said rear member at a plurality of rounded surfaces to form a single-use, disposable protective enclosure;

an anti-bacterial compound impregnating said rear member, said front curved member and said rounded surfaces for destroying bacteria on a remote control device; and an orifice formed in said rear member for enabling said remote control device to be inserted into and removed from said enclosure, said front member, said rear member and said rounded surfaces being comprised of a flexible, stretchable and transparent material for conforming to the shape of said remote control device for providing a disposable, protective sanitation barrier to human infection.

2. The disposable cover of claim 1 wherein said rounded surfaces enable said orifice to close for enclosing said remote control device.

3. The disposable cover of claim 1 wherein said orifice is parallel to an oblong dimension of said flat surface of said rear member.

4. The disposable cover of claim 1 wherein said cover is comprised of a latex material.

5. The disposable cover of claim 1 wherein said cover is comprised of a polyurethane compound.

6. The disposable cover of claim 1 wherein said cover is comprised of polyvinyl chloride.

7. The disposable cover of claim 1 wherein said cover is comprised of nitrile rubber.

8. The disposable cover of claim 1 wherein said cover is comprised of silicon.

9. The disposable cover of claim 1 wherein said cover is comprised of neoprene.

10. The disposable cover of claim 1 wherein said cover is comprised of styrenic elastomer.

11. A disposable cover for use with a remote control device for providing a protective barrier to human infection comprising:

a rear member having a flat surface;

a front curved member integrally molded in a seamless unitary, one-piece construction with said rear member at a plurality of rounded surfaces to form a single-use, disposable protective enclosure;

an anti-bacterial compound impregnating said rear member, said front curved member and said rounded surfaces for destroying bacteria on a remote control device, said anti-bacterial compound comprising a Styrene-Ethylene-Butylene (Ethylene)-Styrene Copolymer compound; and an orifice formed in said rear member for enabling said remote control device to be inserted into and removed from said enclosure, said front member, said rear member and said rounded surfaces being comprised of a flexible, stretchable and transparent material for conforming to the shape of said remote control device for providing a disposable, protective sanitation barrier to human infection.

12. A disposable cover for use with a remote control device for providing a protective barrier to human infection comprising:

a front member having a continuously flat surface;

a rear member having a flat rectangular surface, said rear member integrally molded in a seamless unitary, one-piece construction with said front member at a plurality of rounded surfaces to form a single-use, disposable protective enclosure;

an anti-bacterial compound impregnating said front member, said rear member and said rounded surfaces for destroying bacteria on a remote control device; and an orifice formed in said rectangular surface of said rear member for enabling a remote control device to be inserted into and removed from said enclosure, said front member, said rear member and said rounded surfaces being comprised of a flexible, stretchable and transparent material for conforming to the shape of said remote control device for providing a disposable, protective sanitation barrier to human infection.

13. The disposable cover of claim 12 wherein said rounded surfaces enable said orifice to close for enclosing said remote control device.

14. The disposable cover of claim 12 wherein said flat rectangular surface of said rear member includes a long dimension and a short dimension.

15. The disposable cover of claim 14 wherein said orifice is formed parallel to said long dimension of said flat rectangular surface.

* * * * *